US006192999B1

(12) United States Patent
Nguyen

(10) Patent No.: US 6,192,999 B1
(45) Date of Patent: Feb. 27, 2001

(54) EXTENDED DRILL BIT NOZZLE HAVING EXTENDED RETAINER

(75) Inventor: Quan V. Nguyen, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/170,412

(22) Filed: Oct. 13, 1998

Related U.S. Application Data

(60) Provisional application No. 60/063,176, filed on Oct. 20, 1997, and provisional application No. 60/061,747, filed on Oct. 13, 1997.

(51) Int. Cl.[7] ..... E21B 10/18; E21B 10/60

(52) U.S. Cl. ..... 175/340; 175/393

(58) Field of Search ..... 175/340, 393, 175/424; 239/602, 591

(56) References Cited

U.S. PATENT DOCUMENTS

| | | | | |
|---|---|---|---|---|
| 2,950,090 | * | 8/1960 | Swart | 175/340 |
| 3,084,751 | * | 4/1963 | Scarborough | 175/340 |
| 3,111,179 | * | 11/1963 | Albers et al. | 175/340 |
| 3,115,200 | * | 12/1963 | Mandrell | 175/340 |
| 3,645,331 | * | 2/1972 | Maurer et al. | 175/393 |
| 4,301,877 | | 11/1981 | Cloud | 175/340 |
| 4,400,024 | * | 8/1983 | Ratcliff et al. | 175/340 |
| 4,427,221 | * | 1/1984 | Shay, Jr. | 175/340 |
| 4,687,067 | * | 8/1987 | Smith et al. | 175/340 |
| 4,711,311 | | 12/1987 | Underwood et al. | 175/340 |
| 5,072,796 | * | 12/1991 | Shen et al. | 175/340 |
| 5,494,122 | | 2/1996 | Larsen et al. | 175/340 |

* cited by examiner

*Primary Examiner*—Brian L. Johnson
*Assistant Examiner*—Joselynn Z. Sliteris
(74) *Attorney, Agent, or Firm*—Conley, Rose & Tayon, P.C.

(57) ABSTRACT

A novel nozzle and retainer assembly are used in an earth boring rock bit. A tapered interface between the nozzle and retainer protects the nozzle from impact and breakage downhole. A bushing may also be used in conjunction with an alternative nozzle and retainer assembly.

69 Claims, 10 Drawing Sheets

FIG. 2
(PRIOR ART)
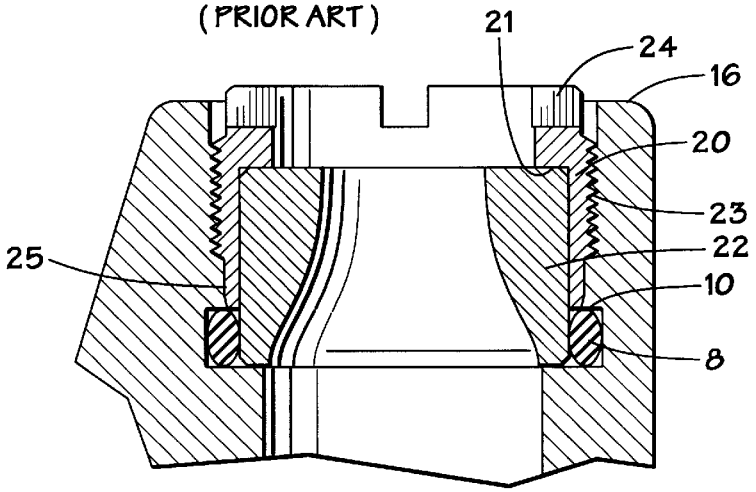
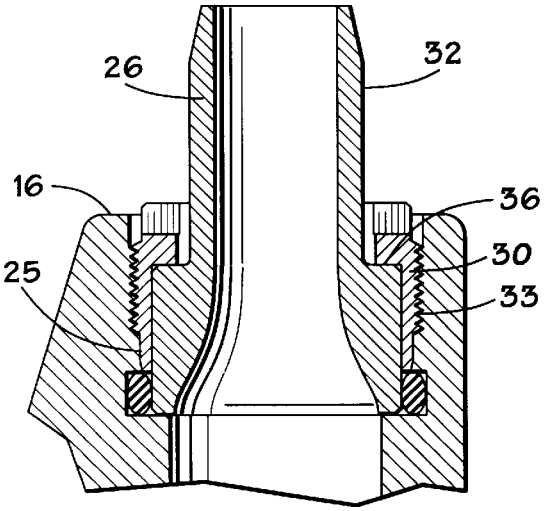
FIG. 3
(PRIOR ART)
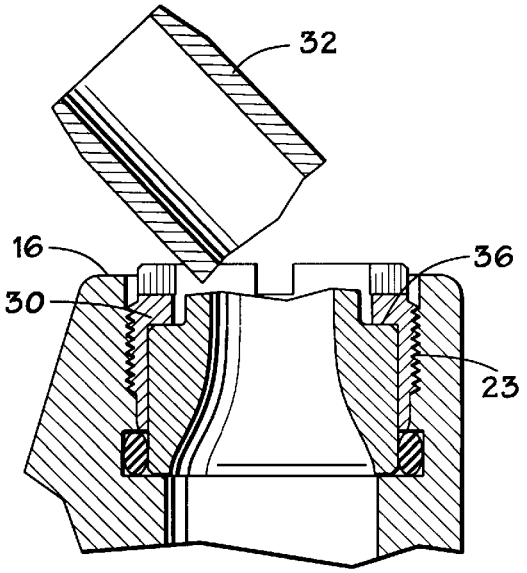
FIG. 4
(PRIOR ART)

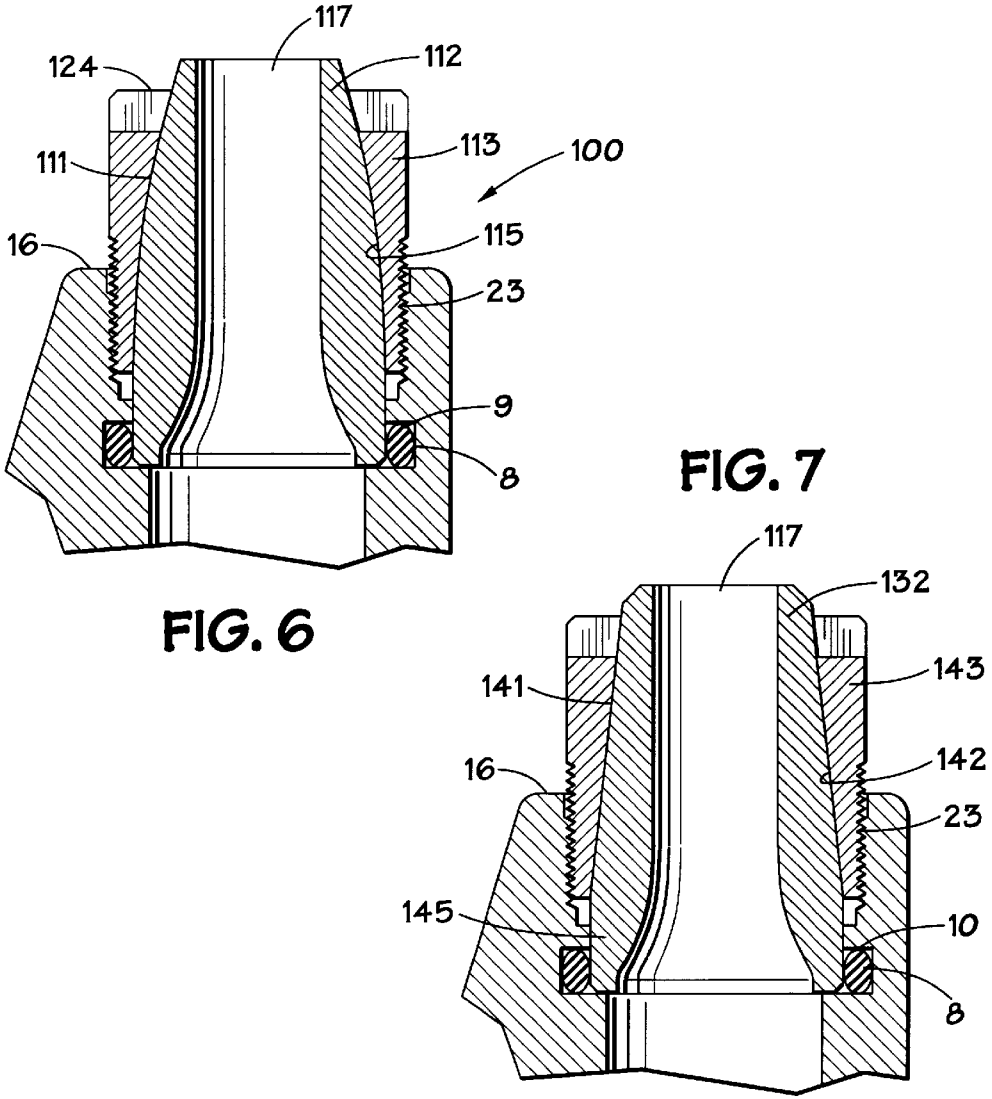
FIG. 6
FIG. 7
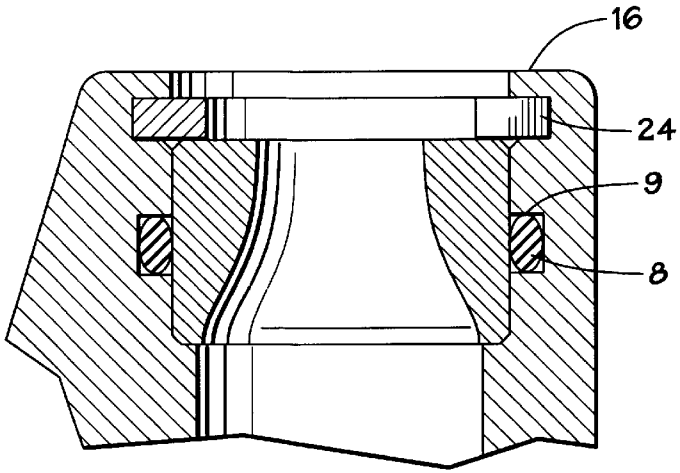
FIG. 5
(PRIOR ART)

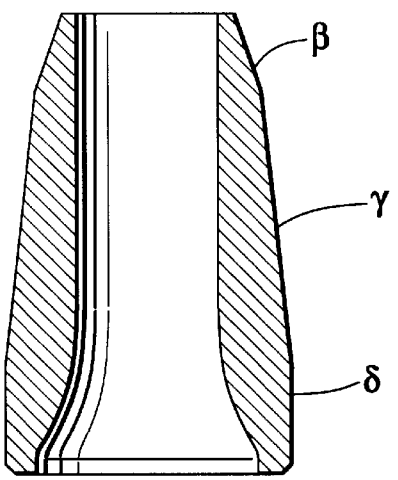
FIG. 9A
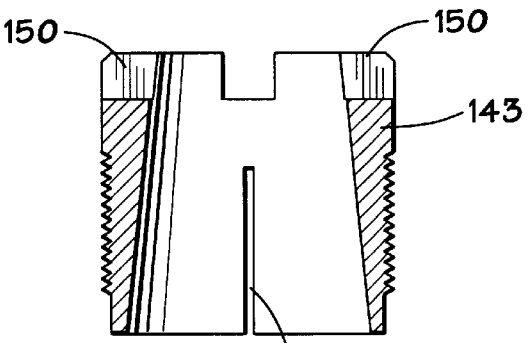
FIG. 10
FIG. 8
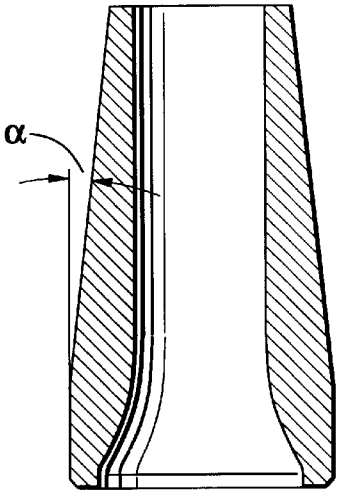
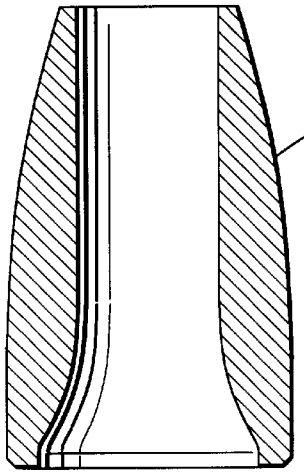
FIG. 9B

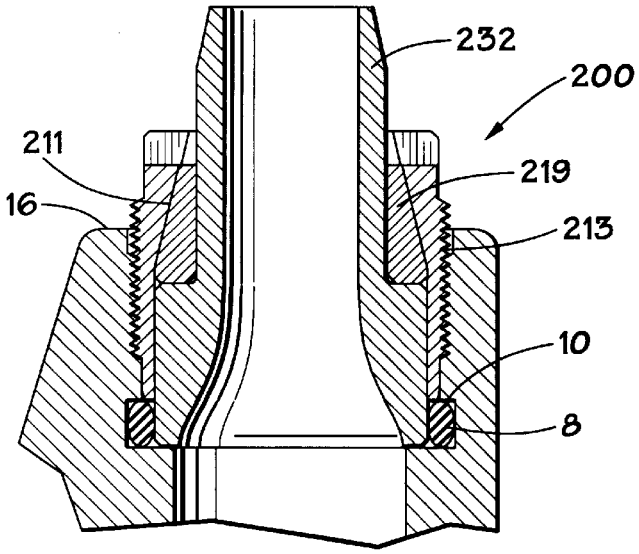
FIG. 11 A
FIG. 11 B
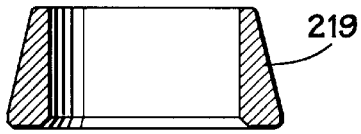
FIG. 11 E
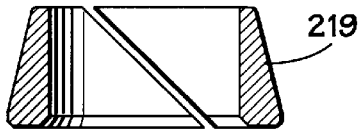
FIG. 11 C
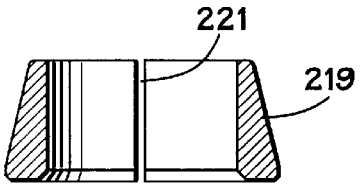
FIG. 11 F
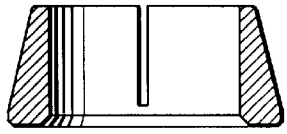
FIG. 11 D
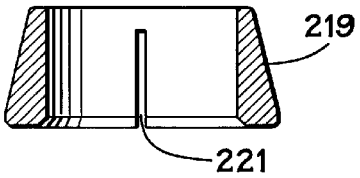
FIG. 11 G
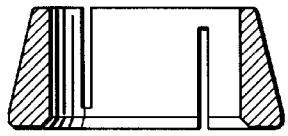

FIG. 11 H
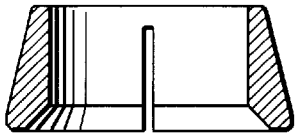
FIG. 11 I
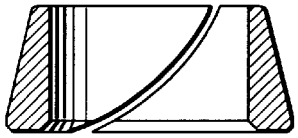
FIG. 11 J
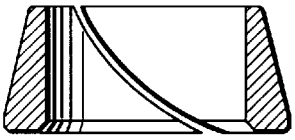
FIG. 11 K
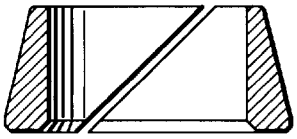
FIG. 11 L
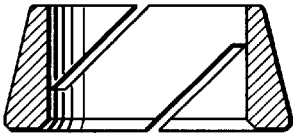
FIG. 11 M
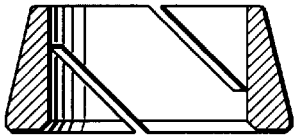
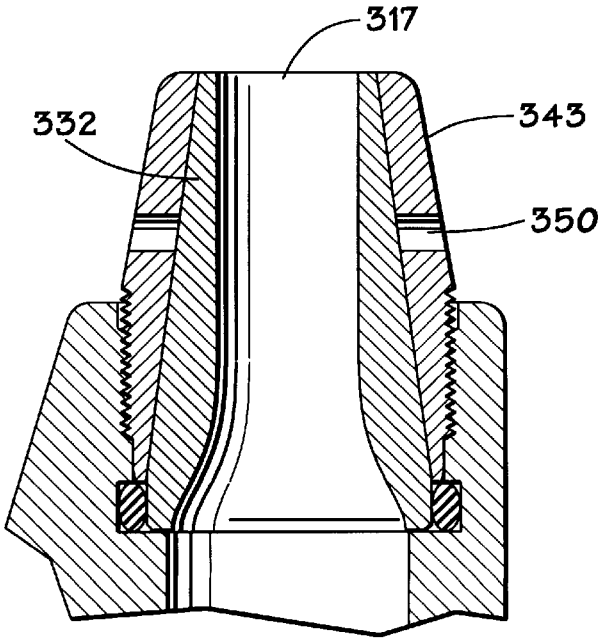
FIG. 12

EXTENDED DRILL BIT NOZZLE HAVING EXTENDED RETAINER

CROSS-REFERENCE TO RELATED APPLICATIONS

This application relates back to provisional application Ser. No. 60/061,747 filed Oct. 13, 1997 and provisional application Ser. No. 60/063,176 filed Oct. 20, 1997.

STATEMENT REGARDING FEDERALLY SPONSORED RESEARCH OR DEVELOPMENT

Not Applicable.

BACKGROUND OF THE INVENTION

It is well known in the art of subterranean drilling to use a drilling fluid to remove cuttings and to cool the bit. It is further known to use nozzles that are mounted on the bit body to control and direct the drilling fluid. The drilling fluid is typically forced through the drill string under pressure, so as to exit the nozzles with some desired velocity. The drilling fluid can be any of a variety of materials, including but not limited to air, water, and drilling mud (oil- or water-based). Nozzles control the direction, flow rate, and back-pressure of the fluid and provide a medium to communicate the drilling fluid from the bit body to the drilling environment. FIG. 1 illustrates nozzle placement on a standard drill bit 1, with a nozzle boss 16 having a mini-extended nozzle 12 extending therefrom and held in place by a hex-head retainer 14. FIG. 2 shows a standard nozzle 22 installed in a nozzle cavity 25 in jet boss 16. The standard nozzle 22 is retained in nozzle cavity 25 with a threaded retainer 20. The nozzle cavity 25 is in fluid communication with internal cavities of the bit (not shown) that receive drilling fluid from the drill string. FIG. 3 shows a mini-extended nozzle 32 installed in nozzle cavity 25. The prior-art mini-extended nozzle is distinguished from the standard nozzle by the extended portion 26 of the nozzle that is reduced in diameter and extends beyond the furthest most surface of the boss 16. The major diameter of the prior-art mini-extended nozzle is of the same length as the total height of the standard nozzle to ensure interchangeability. Both the standard nozzle and the mini-extended nozzle are manufactured from an erosion resistant material such as tungsten carbide. The nozzle cavity can be manufactured in many different locations on the rock bit through the use of common prior-art attachments such as extended nozzle tubes or different machining locations.

Fluid nozzles have conventionally been made from erosion resistant materials such as, coated steels, cemented tungsten carbide, ceramic, composites, and many other materials. Nozzles used on bits in the petroleum industry have to be able to withstand much more rigorous downhole conditions than nozzles used in the mining industry. This is because petroleum drilling uses mud as the drilling fluid, as opposed to mining drilling, where air is the drilling fluid.

Common methods used to retain the fluid nozzles in the drill bit nozzle cavities include threaded retainers 20 as shown in FIG. 2 and disclosed in U.S. Pat. No. 4,687,067, deformable pins as disclosed in U.S. Pat. No. 4,427,221, and snap retainers 24 as shown in FIG. 5 and disclosed in U.S. Pat. No. 3,115,200. A nozzle retention mechanism or system is necessary because the nozzle sustains axial loads from the drilling fluid passing through the nozzle, which tend to force the nozzle out of the nozzle cavity. The nozzle retention mechanism also facilitates field installation of various sizes and types of nozzle configurations into the bit.

One problem with current methods of retaining the fluid nozzle is that the retention method can fail, resulting in the nozzle blowing out of the bit. In particular, if the nozzle were made from cemented tungsten carbide or similarly hard material, the cutting structure could suffer damage when the nozzle came in contact with the cutting structure while drilling. Also, the hydraulic energy loss resulting from the increase in nozzle exit area would markedly reduce drilling efficiency. Hence, it is desirable to minimize the risk of nozzle blow-out.

Retention methods occasionally fail as a result of the high level of bit vibration experienced during drilling. Nozzle blow-outs can also result from mechanical failure of the deformable pin, retaining ring, or threaded retainer, or from any of these elements backing out or coming loose while drilling.

Still referring to FIG. 2, standard drill bit nozzles 22 generally do not extend beyond the nozzle boss 16. The outer surface of the nozzle is typically cylindrical in shape. Likewise, the inside diameter of the retainer 20 is cylindrical. Retainer 20 includes an inner, annular shoulder 21 and a threaded outer surface 23. Shoulder 21 receives and engages nozzle 22 to prevent it from blowing out, while threads 23 engage corresponding threads in nozzle cavity 25 located in nozzle boss 16, to prevent axial movement of retainer 20.

Unlike standard nozzles, mini-extended nozzles 32 extend beyond the nozzle boss 16, as shown in FIG. 3 and are employed to obtain higher fluid energy levels at the hole bottom than would be realized with a standard nozzle. As shown in FIG. 3, mini-extended nozzles 32 are typically held in place by a threaded retainer 30 having a shoulder 36 and external threads 33 as discussed before. The higher fluid energy levels at the hole bottom that available with mini-extended nozzles 32 improve the hole bottom and bit cleaning during drilling, thus improving the bit's rate of penetration and bit performance.

One problem with the conventional mini-extended nozzles 32, as illustrated in FIG. 4, is that if the nozzle hits an obstruction, the impact may break the mini-extended nozzle. The problem is increased when the nozzle is constructed from a brittle material such as tungsten carbide. If the nozzle is broken, pressure losses and possible nozzle washout could result in a trip out of the hole to replace the damaged nozzle or the entire bit. Such trips are very costly and as great efforts are made to reduce the risks of such events. Furthermore, the carbide from a broken tungsten carbide nozzle can damage the cutting structure, noticeably reducing the bit's usable life. One previous solution to this problem was to place a shrouded retainer around the extended portion of the nozzle as shown in FIG. 2 of U.S. Pat. No. 5,494,122. The shrouded retainer of the '222 patent includes threads for engaging the nozzle cavity and an annular lip for receiving the nozzle, and further includes a shroud or extension that is concentric with the nozzle and extends beyond the tip of nozzle boss 16. The '222 patent teaches that an annular gap should be left between the outside wall of the nozzle and the inside wall of the shroud, so as to allow the shroud to absorb the shock of contact with an object without damage to the nozzle. Thus, while the shroud does help protect the nozzle from impact, it has been found that fracture can still occur because the nozzle extension is not in contact with the shroud and thus is radially unsupported from the nozzle's axial shoulder to its exit port. This is particularly the case in instances where an object downhole impacts the portion of the nozzle that extends beyond the shroud.

Referring now to FIG. 5, nozzles generally employ at least one elastomeric sealing member 8 to seal around the nozzle where it is secured into the bit. The purpose of the elastomeric seal is to ensure that the drilling fluid is directed through the nozzle rather than around the outside of the nozzle, which would lead to an undesirable washout. Typically, nozzle seals 8 are radial static seals that fit into either a fully encapsulated seal gland 9 as shown in FIG. 5, or, more preferably, into a semi-encapsulated seal gland 10 as shown in FIG. 2. Part of the top of the semi-encapsulated seal gland 10 is defined by the bottom of the threaded retainer. The advantage of the semi-encapsulated seal gland 10 is that it is easier to remove or install the seal. Other seal gland variations exist, for example U.S. Pat. No. 4,400,024 uses a crushed O-ring gland configuration. It will be understood that the concepts of the present invention can be applied to nozzles that are sealed with any suitable sealing device.

SUMMARY OF THE INVENTION

The present invention comprises a system for retaining mini-extended nozzles in a manner that minimizes the risk of nozzle blow-out or breakage. Mini-extended nozzles is a term referring to the fluid nozzle itself, as contrasted to the nozzle cavity and nozzle boss to which the mini-extended nozzle attaches. The mini-extended nozzle can thus be mounted in any nozzle cavity in the drill bit where sufficient clearance to other parts of the bit allows for its installation. One aspect of the invention includes having the retainer extend along the nozzle beyond the nozzle boss and preferably approximately as far as the tip of the nozzle itself (as long as there is clearance to the cutting structure). Another aspect of the invention includes providing a non-cylindrical interface between the nozzle's outer surface and the inner surface of the retainer and configuring the nozzle and retainer such that an axial load is applied at that interface during operation of the bit. The non-cylindrical interface is preferably a surface of revolution having a continuously increasing radius, and may be conical with a single cone angle, conical with a cone angle that varies along the cone axis, bowed or bullet shaped, or any other non-cylindrical configuration. Another aspect of the invention is a bushing that retains and supports a fluid nozzle. This nozzle may be a mini-extended nozzle. The bushing may or may not include a slit in a variety of configurations.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

DESCRIPTION OF THE FIGURES

For a more detailed description of the preferred embodiment of the present invention, reference will now be made to the accompanying drawings, wherein:

FIG. 2 is a cross-sectional view of a conventional standard length nozzle using a threaded retention system;

FIG. 3 is a cross-sectional view of a conventional mini-extended nozzle using a threaded retention system;

FIG. 4 is a cross-sectional view of the failure mode of the nozzle of FIG. 3;

FIG. 5 is a conventional standard length nozzle using a retainer retention system and an encapsulated static seal gland;

FIG. 6 is a first embodiment of a mini-extended nozzle constructed in accordance with the present invention and using an extended threaded retainer;

FIG. 7 is a second embodiment of a mini-extended nozzle constructed in accordance with the present invention and using an extended threaded retainer;

FIG. 8 is a tapered mini-extended nozzle having a single angle taper profile;

FIG. 9A is a tapered mini-extended nozzle with a multi-angle tapered profile; FIG. 9B is a tapered mini-extended nozzle with a bowed profile;

FIG. 10 is a slotted retainer used to secure a mini-extended nozzle;

FIG. 11A is a conventional mini-extended nozzle with an extending tapered retention system; and FIGS. 11 B–M are various bushing configurations that can be used in the system of FIG. 11A.

FIG. 12 is an extended nozzle and extended nozzle retainer.

DETAILED DESCRIPTION OF A PREFERRED EMBODIMENT

Figure 18:
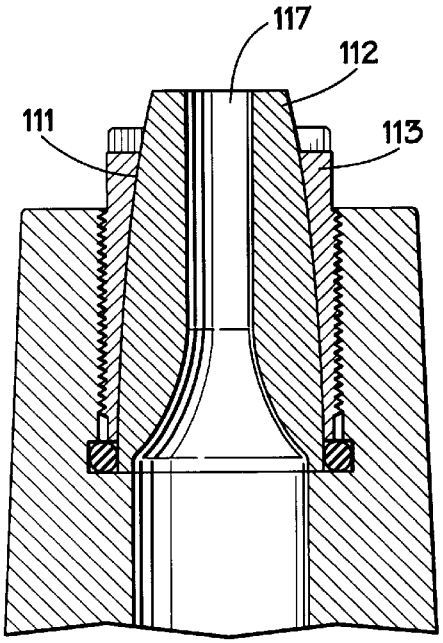
FIG. 18 is a mini-extended nozzle and retainer having an elliptical surface of revolution.
Figure 19:
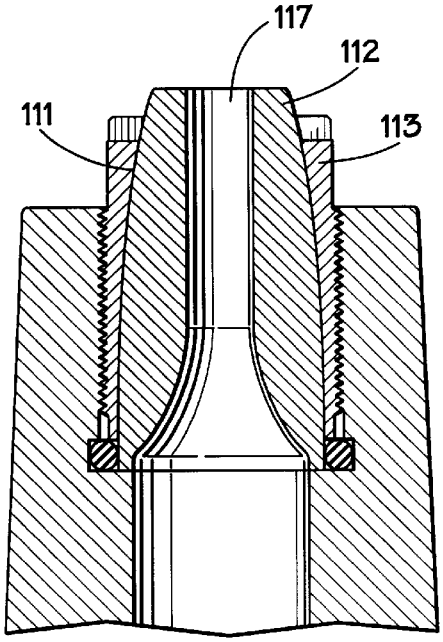
FIG. 19 is a mini-extended nozzle and retainer having a parabolic surface of revolution.
Figure 20:
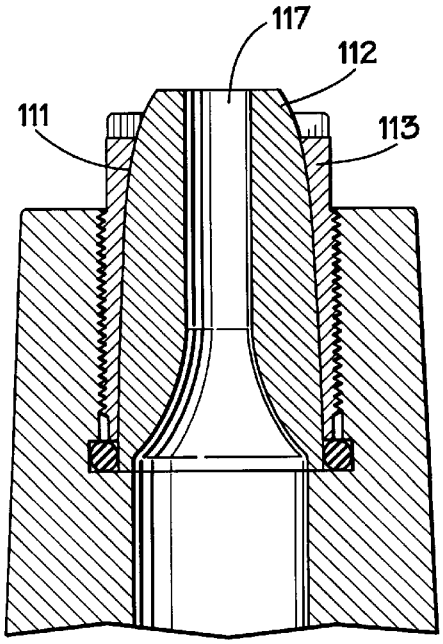
FIG. 20 is a mini-extended nozzle and retainer having an hyperbolic surface of revolution.

Referring initially to FIG. 6, a disclosed embodiment of the invention comprises a nozzle system 100 in which both the mini-extended nozzle 112 and the threaded nozzle retainer 113 extend beyond the nozzle boss 16. The mini-extended nozzle's outer surface 111 preferably comprises a surface of revolution having a radius that increases continuously with distance from the nozzle exit port 117. As shown in FIG. 6, outer surface 111 is generally bowed or bullet shaped, having a continuous curvature between the nozzle exit port 117 and seal gland 9. Surface 111 may be any surface of revolution, including parabolic, elliptical, frustoconical, tapered or the like. FIG. 18 is a mini-extended nozzle and retainer having an elliptical surface of revolution. FIG. 19 is a mini-extended nozzle and retainer having a parabolic surface of revolution. FIG. 20 is a mini-extended nozzle and retainer having an hyperbolic surface of revolution. Outer surface 111 is adjacent to and in contact with the correspondingly shaped inner surface 115 of retainer 113 around all or nearly all of its circumference. The extended retainer 113 not only axially secures nozzle 112 in place, but also supports nozzle 112 in the event of a radial or side load or impact. The remote end 124 of retainer 113 can extend as far as the exit port 117 of nozzle 112, or beyond. For example, FIG. 12 shows a nozzle retainer 343 coextensive with the exit port 317 of an extended nozzle 332.

FIG. 7 shows a mini-extended nozzle 132 utilizing a variation of the non-cylindrical interface of the present invention. Nozzle 132 is held in place by an extended threaded nozzle retainer 143. In this variation, nozzle 132 includes a straight tapered surface 141, defining a truncated cone around the nozzle axis. As in FIG. 6, the outer surface of nozzle 132, including conical surface 141, is adjacent to and in contact with a correspondingly shaped inner surface 142 of threaded nozzle retainer 143 around all or nearly all of its circumference. As above, threaded nozzle retainer 143 secures the extended nozzle 132, provides a surface for axially loading nozzle 132 and also protects the mini-extended nozzle in the event of a radial or side load or impact. The nozzle's taper angle $\alpha$ (FIG. 8), typically ranges between 1–30 degrees.

Variations of the mini-extended nozzle of the present invention include having multiple axial taper angles $\beta$, $\gamma$, $\delta$, as shown in FIG. 9A or an elliptical, hyperbolic, or parabolic profile, an example of which is shown at 151 in FIG. 9B. The term "tapered" as used herein encompasses all of these geometries.

One advantage of the tapered mini-extended nozzles of the present invention is that the strength of the nozzle is increased. As shown in FIGS. 3 and 4, the typical mini-extended nozzle configuration has an axial shoulder 36 where the typical retainer 30 would secure the nozzle. When a conventional mini-extended nozzle 32 sustains a radial or side load, the fracture often occurs at the highly stressed nozzle shoulder 36. In contrast, in the non-cylindrical nozzle retention system of the present invention, the mini-extended nozzle does not require an axial shoulder, thus eliminating the stress concentration location. Additionally, in the present invention, the nozzle's cross section has been increased in the location where the mini-extended nozzle usually has an axial step and the highest bending stress.

Another feature of the present non-cylindrical mini-extended nozzle retention system is that as the threaded nozzle retainer is tightened, the nozzle is loaded in compression. Loading the nozzle in compression further increases the nozzle's ability to withstand radial loading. For the nozzle to fracture, the nozzle must sustain a radial load that creates a bending moment in the nozzle sufficient to create enough tensile load to both overcome the compressive load in the nozzle resulting from the threaded non-cylindrical retainer and cause the material from which the nozzle is constructed to fail. Further increasing the ability of the nozzle/retainer unit to withstand radial loading is the nozzle/retainer's increased moment of inertia. Since the threaded non-cylindrical retainer extends concentrically along the nozzle body, the moment of inertia of the unit is a combination of both the nozzle and the retainer.

The non-cylindrical mini-extended nozzle of the present invention can be sealed using a fully encapsulated seal gland 9 as shown in FIG. 5 or a semi-encapsulated gland 10 as shown in FIG. 2. In general, the semi-encapsulated gland is preferred because the static seal is easier to install and replace than the fully encapsulated seal gland design. In a semi-encapsulated gland as shown in FIG. 11A, the retainer makes up part of the gland. Of course, full encapsulation exists once the retainer is installed. Other static sealing methods have been practiced in the past, but using a static O-ring is typically preferred as the most cost effective method.

Referring to FIG. 7, it is contemplated that the non-cylindrical interface between the nozzle and the retainer of the present invention can have a cylindrical or axially straight portion 145 at the bottom of the nozzle. Not shown but also included in this invention are other variations on the tapered profile that include a cylindrical portion in combination with a non-cylindrical loading surface and a cylindrical portion in combination with a non-cylindrical, non-conical loading surface.

The retainer ring used to secure the tapered nozzle can be secured to the bit body by any suitable convention means. As mentioned in the background section, this invention could be adapted to be used in combination with any of the typical methods used to secure the retainer to the bit (i.e. deformable pin, retainer, threaded retainer, etc.). Likewise, the retainer can be designed to incorporate any suitable driving mechanism, including an external hex head arrangement or an internal hex head arrangement such as are known in the art. Another method commonly used to tighten a threaded retainer comprises utilizing slots or notches in the retainer, such as are disclosed in U.S. Pat. No. 4,400,024. These notches can be in the top of the retainer near the exit port of the nozzle or radially around to outside of the retainer. Referring back to FIG. 12, wrench or tightening slots 350 are formed in nozzle retainer 343. When slots 350 are below exit port 317 as generally shown, nozzle retainer 343 fully surrounds extended nozzle 332 at the nozzle retainer's exit port end. This configuration provides increased protection to the extended nozzle at its most extended region. It may also provide simplified installation.

Figure 1:
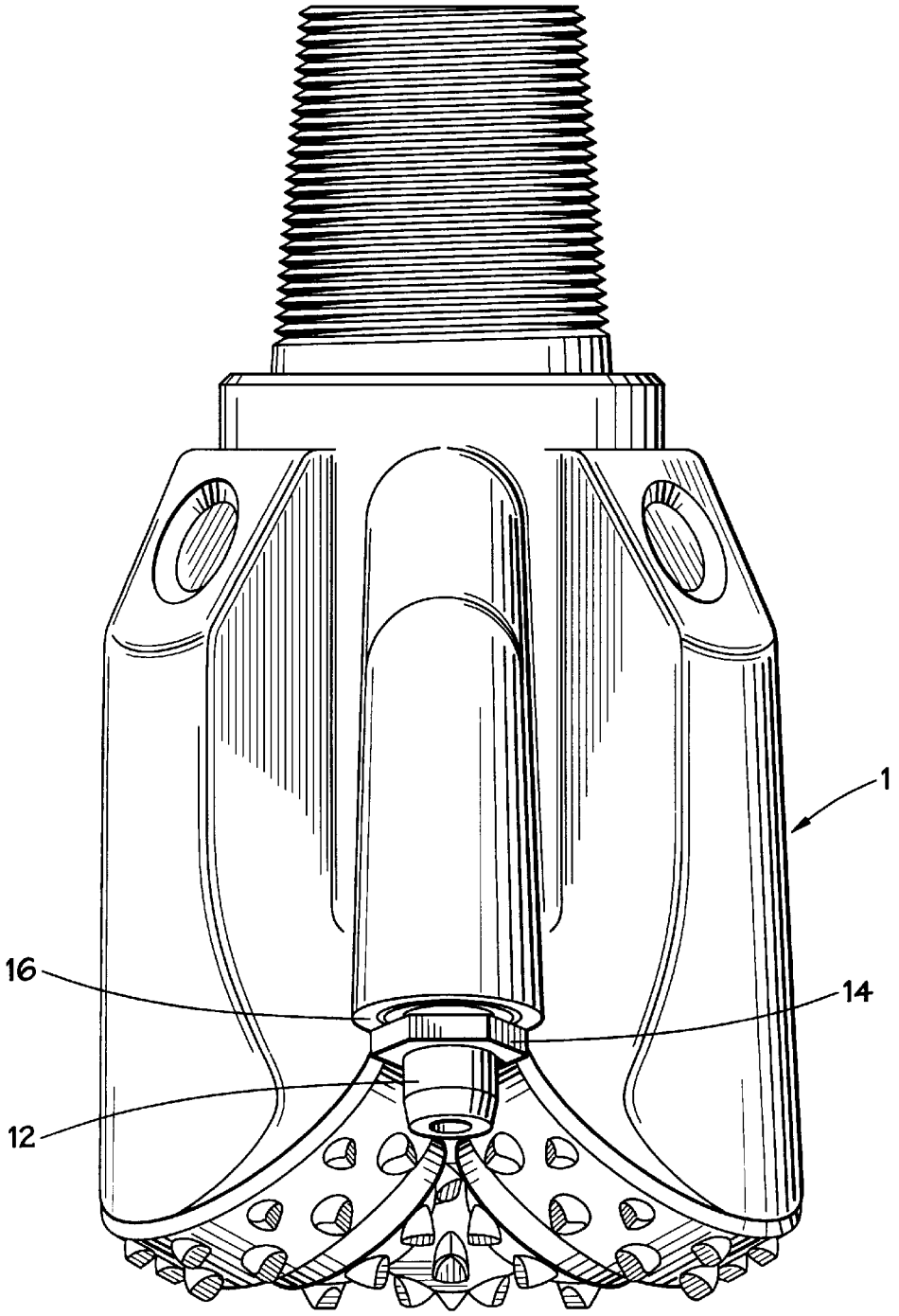
FIG. 1 (PRIOR ART)
FIG. 1 is a side view of a prior art rock bit with a shrouded mini-extended retention system.
Figure 13B:
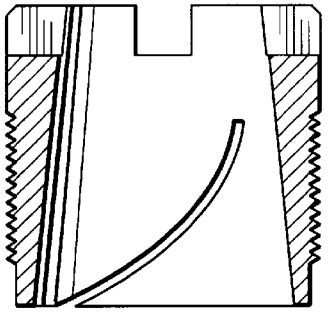
FIGS. 13A–13D are various nozzle retainer configurations.
Figure 13D:
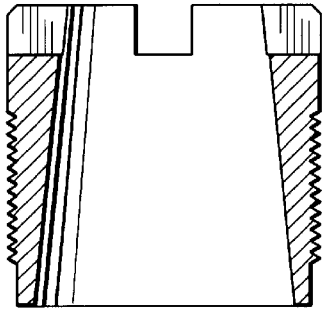
Figure 13A:
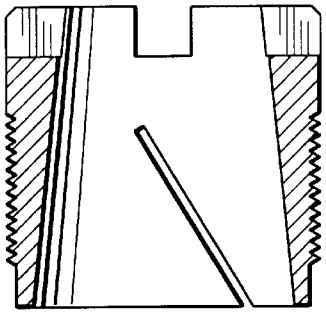
Figure 13C:
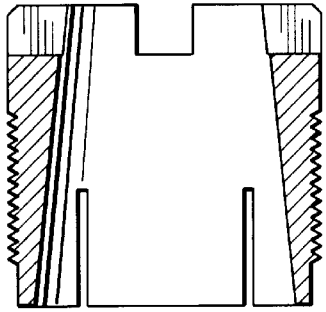
Figure 17C:
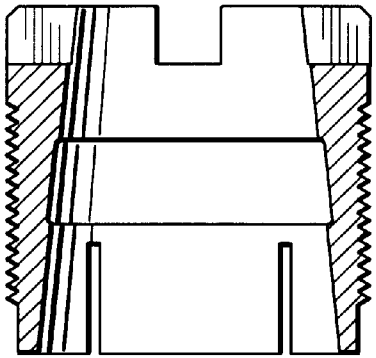
FIGS. 17*a*–17*c* is a mini-extended nozzle retainer with stress relief grooves.
Figure 17B:
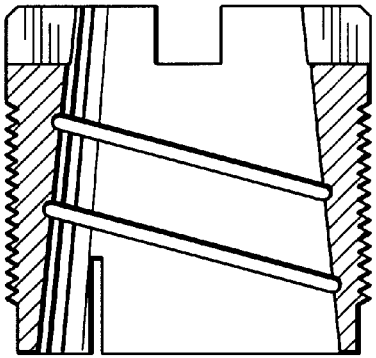
Figure 17A:
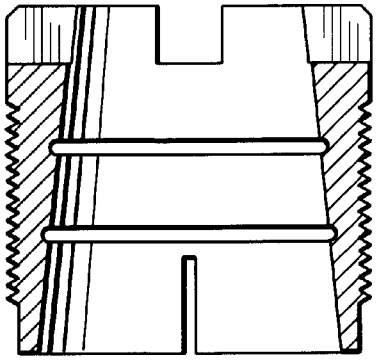

The nozzle and retainer can be assembled as two separate units or the retainer can be joined such as by brazing, welding or the like. The nozzle is often constructed from a cemented tungsten carbide when drilling mud is used as the media that is pumped through the mini-extended nozzles. In order to reduce the cost of producing these tungsten carbide mini-extended nozzles, the outer surface 111 of FIG. 6, and 141 of FIG. 7 of the present mini-extended nozzle is not ground smooth, but is left in its natural state after it has been sintered. The "natural" state of the outside profile of the present nozzle will have minor surface distortion as a result of the tungsten carbide sintering process. To ensure that the retainer conforms to the outside profile of the present nozzle, the present retainer 113 of FIG. 6, and 143 of FIG. 7 preferably include a plurality of slits 18, as shown in FIG. 10. Slits 18 allow the retainer to better conform to minor distortions in the nozzle's outside profile, thus ensuring a nearly uniform circumferential loading of the nozzle as the retainer 113, 143 is tightened. The slits 18 can have any of a variety of configurations. One or more slits can be used and the slits do not have to be parallel to the axis of the nozzle and can alternatively be at an angle with respect to the nozzle axis. For example, a variety of slit configurations, including no slit, are shown in FIGS. 13A–13D. FIG. 13A shows a retainer with a slit non-parallel to the axis of the nozzle. FIG. 13B shows a retainer with a curved slit with respect to the axis of the nozzle. FIG. 13C shows a retainer with a multiple slits. FIG. 13D shows a retainer with no slit. The ability of the retainer to conform to the outer surface of the nozzle can be further enhanced through the use of stress relief grooves that allow for additional flexibility of the inner retainer surfaces as shown in FIGS. 17A–17C. FIG. 17A shows the addition of two grooves concentric to the axis of the nozzle. FIG. 17B shows two grooves angled to the axis of the nozzle. The grooves could also be made as a spiral around the inner surface of the mini-extend nozzle retainer. FIG. 17C shows an enlarged relief slot to further increase the flexibility of the mini-extended nozzle retainer. Variations of these designs are also possible, including double slits at an angle to the axis of the nozzle and double slits with different heights. The preferred form of this invention as shown in FIG. 10, would be to utilize a threaded retainer 143 with the top of the retainer slotted as at 150, so as to receive a tightening tool, or having a hex head shape to enable tightening of the retainer 143.

A preferred angle α for a straight tapered mini-extended nozzle shown in FIGS. 7 and 8 is between 4 and 9 degrees. The taper angle of 4–9 degrees yields a retainer that extends most of the length of a mini-extended nozzle for enhanced retention and radial support. A taper angle of 6.5° has been found suitable. The preferred retainer ring also has slits 18 such that retainer ring 143 can maximally conform to the outer surface of the mini-extended nozzle. Also, the preferred system utilizes a radial static O-ring seal 8 with a semi-encapsulated gland 10 (such as that shown in FIG. 11A) for ease of static O-ring installation or replacement.

The present retaining system can also be adapted for use with a conventional (shouldered) mini-extended nozzle, such as system 200 is shown in FIG. 11A. A conventional mini-extended nozzle 232 is used in conjunction with a bushing or compensator ring 219 inserted between the nozzle 232 and the retainer 213. The outside of the bushing 219 has a non-cylindrical outer surface 211, which interfaces with the corresponding non-cylindrical inner surface of retainer 213. Bushing 219 is preferably a separate piece, but can be brazed or welded to the mini-extended nozzle, or affixed in a similar manner. As described above and partially illustrated in FIGS. 11B–M, bushing 219 can include one or more optional slits 221 in a variety of configurations so as to allow it to better conform to the outer surface of mini-extended nozzle 232. The term "slits" also encompasses a full split through the bushing. Thus, if at least two splits are included in a bushing, it becomes a multi-piece bushing. It is preferred that at least one and preferably both the retainer 213 and bushing 219 extend beyond nozzle boss 16, and preferably terminate near the tip of mini-extended nozzle 232. It is further preferred that the inner surface of bushing 219 contact and provide support for mini-extended nozzle 232 and that the inner surface of retainer 213 contact and provide support for bushing 219. When a bushing 219 is used, it is preferred that at least the bushing 219 have slits, but it will be understood that retainer 213 may also be slit. It will further be understood that the slits in retainer 213 may be one or more full splits through the retainer.

Figure 14:
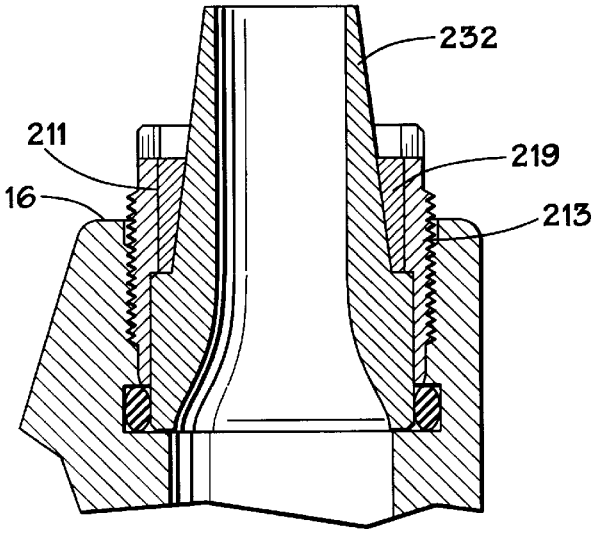
FIG. 14 is a mini-extended nozzle with a different tapered retention system.

FIG. 11A also shows the outer surface 211 of the bushing at an angle to vertical. The inner surface of the bushing 219 is near vertical to correspond with the angle of the mini-extended nozzle 232. The same goal may be obtained where the outer surface of the mini-extended nozzle is at an angle by placing the inner surface of the bushing 219 at an angle as shown in FIG. 14. This may result in the outer surface 211 of the bushing being near vertical to match the inner surface of the retainer 213.

Figure 15:
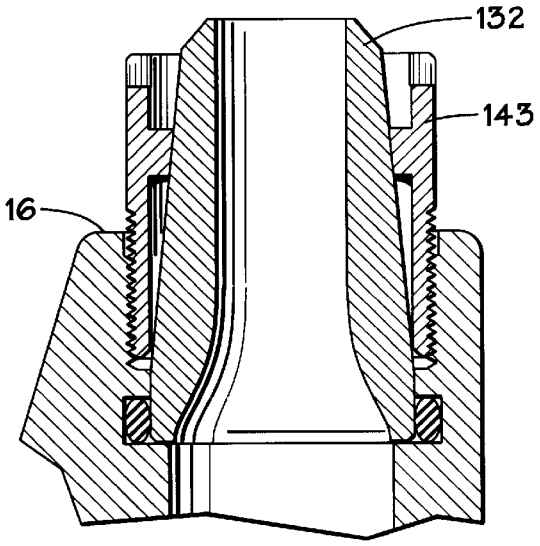
FIG. 15 is a mini-extended nozzle with a retainer.
Figure 16:
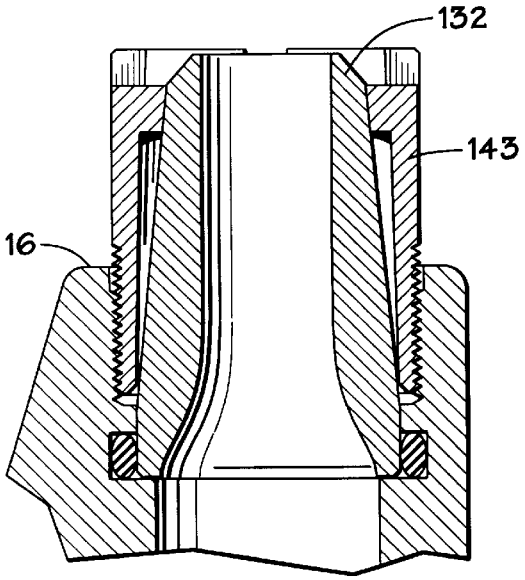
FIG. 16 is a mini-extended nozzle with a retainer.

Referring to the Figures generally, as can be seen the nozzle retainer is in contact with the mini-extended nozzle above the nozzle boss, be it direct contact such as in FIG. 7, or indirect contact such as in FIG. 11A. Indirect contact may also be present by a bonding material such as brazing or gluing. In other words, the advantages of the invention may be realized so long as the retainer is in contact with the mini-extended nozzle, even if another layer or object is interposed (such as a bushing) between the retainer and the mini-extended nozzle. Further, the contact need not occur at all points along the length of the mini-extended nozzle. For instance, FIG. 7 shows tightening slots (i.e., open areas) at the discharge end of the fluid nozzle. FIG. 15 shows contact between the mini-extended nozzle and the retainer at a point below the discharge end. This contact may occur outside the nozzle boss, or inside the nozzle box. Nonetheless, the retainer may be more effective as the contact is located closer to the remote end of the mini-extended nozzle, as shown in FIG. 16.

Hence, many of the same benefits realized from a fully non-cylindrical nozzle/retainer system would also be realized by the application of the present principles to conventional mini-extended nozzles as shown in FIG. 3. These include:

The non-cylindrical extended nozzle retention system increases the protection and strength of a mini-extended nozzle by:

1) increasing the effective radial cross-section of the mini-extended nozzle,
2) increasing moment of inertia for the mini-extended nozzle/tapered retainer system,
3) increasing radial load strength of the tapered nozzle as a result of the axially loading applied by the retainer to the nozzle, The non-cylindrical extended nozzle retention system provides improved nozzle retention because of the tapered/threaded locking effect of the split nozzle retainer. As the vibration loads and axial loads from the drilling fluid increase, the resulting radial loads increase around the nozzle, further locking the nozzle in place, thus greater reliability is achieved regarding nozzle retention.

The split or slit retainer design compensates for minor surface distortion of the surfaces of mini-extended nozzles.

As will now be appreciated by one of ordinary skill in the art, the present invention can be used in any of the commonly used earth boring bits. For example, a roller cone bit, a hammer cone bit, a drag bit, or any other appropriate earth boring bit using fluid nozzles may be used.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An earth boring bit including a vibration and breakage protection nozzle retention apparatus, comprising:

a rock bit body forming at least one nozzle cavity for directing fluid therethrough;

a nozzle forming an entrance end and an exit end, said entrance end being inserted in a first one of said nozzle cavities and said exit end extending beyond said first cavity, said nozzle also having an outer surface, wherein at least a portion of said outer surface forms a first tapered surface that tapers radially inward toward the exit end;

a nozzle retainer having a first end attached to said first nozzle cavity, a second end opposite thereto, an inner surface, and an outer surface, at least a portion of said inner surface of said nozzle retainer compressively engaging the first tapered surface of said nozzle at a location beyond said rock bit body so as to retain said nozzle in the cavity, the first tapered surface being tapered at an angle of less than or equal to about 30 degrees, said angle being defined by the intersection of a longitudinal axis through said nozzle and a tangent line to at least one point on said first tapered surface that is in contact with the inner surface of the nozzle retainer.

2. The earth boring bit of claim 1, wherein said nozzle retainer contacts indirectly said nozzle.

3. The earth boring bit of claim 1, further comprising:

at least one slit in said nozzle retainer.

4. The earth boring bit of claim 3, wherein said slit is oriented in a generally longitudinal direction.

5. The earth boring bit of claim 3, wherein said slit is disposed at an angle to the longitudinal direction.

6. The earth boring bit of claim 3, wherein said slit is curved.

7. The earth boring bit of claim 1, wherein said nozzle retainer contacts directly said nozzle.

8. The earth boring bit of claim 1, further comprising threads along the outer surface of said nozzle retainer for attachment of said nozzle retainer in said nozzle cavity.

9. The earth boring bit of claim 1, further comprising a slot along the outer surface of said nozzle retainer and a corresponding slot in the inner surface of the nozzle cavity, said slot being capable of receiving a deformable pin to maintain in place said retainer in said nozzle cavity.

10. The earth boring bit of claim 1, said second end of said nozzle retainer being configured to extend beyond said exit end of said nozzle.

11. The earth boring bit of claim 1, said exit end of said nozzle being configured to extend beyond said second end of said nozzle retainer.

12. The earth boring bit of claim 1, said second end of said nozzle retainer being configured to be coextensive with said exit port end of said nozzle.

13. The earth boring bit of claim 1 wherein said first tapered surface is a linear taper.

14. The earth boring bit of claim 1, wherein said angle is between 1 and 9 degrees.

15. The earth boring bit of claim 1, wherein said angle is between 1 and 30 degrees.

16. The earth boring bit of claim 1 wherein said first tapered surface of said nozzle is curved.

17. The earth boring bit of claim 1, wherein said nozzle retainer includes stress relief grooves.

18. The earth boring bit of claim 1, wherein the rock bit body includes an extended tube and the cavity is located at the end of the extended tube.

19. The earth boring bit of claim 1, wherein the rock bit body includes a nozzle boss and the cavity is located in the nozzle boss.

20. The earth boring bit of claim 1, wherein the second end of the nozzle retainer extends beyond the cavity.

21. An earth boring bit including a vibration and breakage protection nozzle retention apparatus, comprising:

a rock bit body forming at least one nozzle cavity for directing fluid therethrough;

a nozzle forming an entrance end and an exit end, said entrance end being inserted in said nozzle cavity and said exit end extending beyond said cavity, said nozzle also having an outer surface;

a retainer having a first end attached to said nozzle cavity, a second end opposite thereto, an inner surface, and an outer surface, wherein said outer surface of said nozzle and said inner surface of said nozzle retainer form an area of contact outside said nozzle cavity, said inner surface of said nozzle retainer substantially conforming to said outer surface of said nozzle body at said area of contact, at least a portion of said area of contact being tapered at an angle of less than or equal to 30 degrees, said angle of taper being defined by the intersection of the longitudinal axis through said nozzle retainer and a tangent line to at least one point on said area of contact.

22. The earth boring bit of claim 21, wherein said attachment of said first end of said nozzle retainer to said nozzle cavity applies compressive force to said nozzle body.

23. The earth boring bit of claim 21, further comprising:

at least one slit in said nozzle retainer, said slit being capable of ensuring a tight fit between said nozzle and said nozzle retainer.

24. The earth boring bit of claim 23, wherein said slit is disposed along the longitudinal axis.

25. The earth boring bit of claim 23, wherein said slit is disposed at an angle to the longitudinal axis.

26. The earth boring bit of claim 23, wherein said slit is curved.

27. The earth boring bit of claim 21, wherein said nozzle retainer contacts directly said nozzle.

28. The earth boring bit of claim 21, further comprising threads along the outer surface of said nozzle retainer and said threads being capable of attaching said nozzle retainer in said nozzle cavity.

29. The earth boring bit of claim 21, said second end of said nozzle retainer being configured to extend beyond said exit end of said nozzle.

30. The earth boring bit of claim 21, said exit end of said nozzle being configured to extend beyond said second end of said nozzle retainer.

31. The earth boring bit of claim 21, said second end of said nozzle retainer being configured to be coextensive with said exit end of said nozzle.

32. The earth boring bit of claim 21 wherein said taper is linear.

33. The earth boring bit of claim 21, wherein said angle is between 1 and 9 degrees.

34. The earth boring bit of claim 21, wherein said angle is between 1 and 30 degrees.

35. The earth boring bit of claim 21 wherein said outer surface of said nozzle body and said inner surface of said nozzle retainer are curved.

36. The earth boring bit of claim 21 wherein said area of contact occurs at a location beyond said cavity.

37. The earth boring bit of claim 21, wherein said nozzle retainer includes stress relief grooves.

38. The earth boring bit of claim 21, wherein the rock bit body includes an extended tube and the cavity is located at the end of the extended tube.

39. The earth boring bit of claim 21, wherein the rock bit body includes a nozzle boss and the cavity is located in the nozzle boss.

40. The earth boring bit of claim 21, wherein the second end of the nozzle retainer extends beyond the cavity.

41. The earth boring bit of claim 21, wherein said nozzle and said retainer contact indirectly.

42. The earth boring bit of claim 41, wherein said indirect contact is brazing.

43. An earth boring bit including a vibration and breakage protection nozzle retention apparatus, comprising:

a rock bit body forming at least one nozzle cavity for directing fluid therethrough;

a nozzle forming an entrance end and an exit end, said entrance end being inserted in said nozzle cavity, said nozzle also having an outer surface;

a retainer having a first end attached to said nozzle cavity, a second end opposite thereto, and an inner surface disposed about the outer surface of the nozzle; and a bushing compressed between the outer surface of the nozzle and the inner surface of the retainer.

44. The earth boring bit of claim 43 wherein at least a portion of the outer surface of the nozzle is tapered and wherein the bushing has a tapered inner surface conformingly contacting the outer surface of the nozzle.

45. The earth boring bit of claim 44 wherein the taper is curved.

46. The earth boring bit of claim 43 wherein at least a portion of the inner surface of the retainer is tapered and the bushing has a tapered outer surface conformingly contacting the inner surface of the retainer.

47. The earth boring bit of claim 46 wherein the taper is curved.

48. The earth boring bit of claim 43 wherein the exit end of the nozzle extends beyond the cavity.

49. The earth boring bit of claim 43 wherein the second end of the retainer extends beyond the cavity.

50. The earth boring bit of claim 43, wherein said bushing body has at least one bushing slit.

51. The earth boring bit of claim 50, wherein said bushing slit is disposed along the longitudinal axis.

52. The earth boring bit of claim 50, wherein said bushing slit is disposed at an angle to the longitudinal axis.

53. The earth boring bit of claim 50, wherein said bushing slit is curved.

54. The earth boring bit of claim 43 wherein the retainer defines at least one slit.

55. The earth boring bit of claim 54, wherein said slit is disposed along the longitudinal axis.

56. The earth boring bit of claim 54, wherein said slit is disposed at an angle to the longitudinal axis.

57. The earth boring bit of claim 54, wherein said slit is curved.

58. The earth boring bit of claim 43 wherein said bushing is non-metallic.

59. The earth boring bit of claim 43 wherein said bushing is metallic.

60. The earth boring bit of claim 43, wherein said bushing is compressed between the outer surface of the nozzle and the inner surface of the retainer at a location beyond said rock bit body.

61. The earth boring bit of claim 43 wherein at least a portion of the inner surface of the retainer is a non-cylindrical surface of revolution and the bushing has a non-cylindrical surface of revolution conformingly contacting the inner surface of the retainer.

62. An earth boring bit including a vibration and breakage protection nozzle retention apparatus, comprising:

a rock bit body forming at least one nozzle cavity for direction of fluid therethrough;

a nozzle forming an entrance end and an exit end, said entrance end being inserted in said nozzle cavity and said exit end extending beyond said cavity, said nozzle also having an outer surface;

a retainer have a first end attached to said nozzle cavity, a second end opposite thereto, an inner surface, and an outer surface, wherein said outer surface of said nozzle and said inner surface of said nozzle retainer form an area of contact outside said rock bit body, said inner surface of said nozzle retainer substantially conforming to said outer surface of said nozzle body at said area of contact, wherein said outer surface of said nozzle and said inner surface of said retainer are defined as a non-cylindrical surface of revolution.

63. The earth boring bit of claim 62, wherein said non-cylindrical surface of revolution is elliptical.

64. The earth boring bit of claim 62, wherein said non-cylindrical surface of revolution is parabolic.

65. The earth boring bit of claim 62, wherein said non-cylindrical surface of revolution is hyperbolic.

66. The earth boring bit of claim 62, wherein said non-cylindrical surface of revolution is bullet shaped.

67. The earth boring bit of claim 62, wherein said non-cylindrical surface of revolution is bowed.

68. An earth boring bit including a vibration and breakage protection nozzle retention apparatus, comprising:

a rock bit body forming at least one nozzle cavity for directing fluid therethrough;

a nozzle forming an entrance end and an exit end, said entrance end being inserted in said nozzle cavity and said exit end extending beyond said cavity, said nozzle also having an outer surface, wherein at least a portion of said outer surface forms a first tapered surface that tapers radially inward toward the exit end;

a nozzle retainer having a first end attached to said nozzle cavity, a second end opposite thereto, an inner surface, and an outer surface, at least a portion of said inner surface of said nozzle retainer compressively engaging the first tapered surface to retain said nozzle in the cavity, the first tapered surface being tapered at an angle of less than or equal to about 30 degrees, said angle being defined by the intersection of a longitudinal axis through said nozzle and a tangent line to at least one point on said first tapered surface that is in contact with the inner surface of the nozzle retainer, wherein said nozzle retainer extends beyond said cavity, said outer surface of nozzle retainer having a first length and a second length, said first length being the total length of said outer surface between said first end and said second end, said second length being the length of said outer surface within the cavity, said first length being at least twice said second length.

69. An earth boring bit including a vibration and breakage protection nozzle retention apparatus, comprising:

a rock bit body forming at least one nozzle cavity for directing fluid therethrough;

a nozzle forming an entrance end and an exit end, said entrance end being inserted in a first one of said nozzle cavities and said exit end extending beyond said first cavity, said nozzle also having an outer surface, wherein at least a portion of said outer surface forms a first surface;

a nozzle retainer having a first end attached to said first nozzle cavity, a second end opposite thereto, a tapered inner surface, and an outer surface, at least a portion of said tapered inner surface of said nozzle retainer compressively engaging the first surface of said nozzle at a location beyond said rock bit body so as to retain said nozzle in the cavity.

* * * * *